US006364727B1

(12) United States Patent
Rangel

(10) Patent No.: US 6,364,727 B1
(45) Date of Patent: Apr. 2, 2002

(54) SWIMMING AID WITH MOVABLE FINS

(75) Inventor: Ricardo Valdez Rangel, Playas de Tijuana (MX)

(73) Assignee: Advanced Plastics International, National City, CA (US)

( * ) Notice: Subject to any disclaimer, the term of this patent is extended or adjusted under 35 U.S.C. 154(b) by 0 days.

(21) Appl. No.: 09/566,402

(22) Filed: May 8, 2000

(51) Int. Cl.[7] ..... A63B 31/12
(52) U.S. Cl. ..... 441/59; 441/60
(58) Field of Search ..... 441/55, 59, 60, 441/56, 58, 61, 62; D21/804, 806

(56) References Cited

U.S. PATENT DOCUMENTS 2,017,463 A * 10/1935 Komadina ..... 441/58
3,290,707 A * 12/1966 Montgomery ..... 441/59

* cited by examiner

*Primary Examiner*—Sherman Basinger
(74) *Attorney, Agent, or Firm*—Donn K. Harms

(57) ABSTRACT

A swimming aid that includes a support panel fastened to an arm and/or leg with two movable fins extending along the panel. The fins are configured so that when a swimmer is moving his or her limb in a power stroke, the fins will pivot outwardly to increase the width pushing against the water, increasing swimmer efficiency and speed. During the recovery stroke, the fins pivot back against the limb, reducing the resistance to limb movement. A strap extending through slots in the support panel and the fins serves to hold the assembly to the swimmer's limb while providing the pivot line and the extent to which the fins will pivot during a power stroke. Several different arrangements of support panel, fins and strap path may be used. In one embodiment a further top member of flexible material is secured over the fins opposite the support panel.

19 Claims, 3 Drawing Sheets

SWIMMING AID WITH MOVABLE FINS

FIELD OF THE INVENTION

This invention relates to devices for assisting persons in swimming that include fins or other devices for fastening to a swimmer's limbs to improve the power and efficiency of swimming motions.

BACKGROUND OF THE INVENTION

A variety of different devices have been developed to make swimming easier and to increase a swimmer's speed and control. Among these are swim fins that include a shoe-like receptacle for the feet and an enlarged fin fastened to the shoe to aid in leg kick propulsion. Webbed gloves and the like have been used to improve arm stroke propulsion.

While these prior devices do improve a swimmers speed, they tend to have low efficiency and are cumbersome, heavy. Conventional swim fins make walking when out of the water difficult. Webbed gloves and the like make grasping and manipulating tools and the like very difficult. Thus, there is a continuing need for improvements in such swimming aids for use by general recreational swimmers, scuba divers, surfers and the like.

Therefore, it is an object of this invention to provide a swimming aid that can be secured to a swimmer's arms and/or legs to greatly improve the propulsive effects of conventional arm strokes and leg kicks. Another object of this invention is to provide a simple, light weight and efficient swimming aid. A further object of this invention is to provide a swimming aid that is easily secured to, and released from, a swimmer's arms and/or legs. Still another object of this invention is to provide a swimming aid that is easily adjusted for maximum efficiency with swimmers of widely varying skill and strength. Yet a further object of this invention is to provide swimming aids that do not interfere with walking when out of the water or with grasping tools and the like.

SUMMARY OF THE INVENTION

The above-noted objects, and others, are accomplished in accordance with this invention by a movable fin swimming aid that comprises a support panel that fits over a portion of the front surface of a limb, typically the forearm, upper arm, calf or thigh, a pair of movable fins pivotally secured to the support panel near the center thereof and lying approximately parallel to the limb and a strap for flexibly securing the fins and supports together and the resulting assembly to a limb.

Any suitable material may be used for the support panel, fins and strap. The support panel should fit the limb or have some flexibility to accommodate to limbs of different circumference or shape. Typically, the support panel may be formed from Nylon or a flexible, rubber-like material. The movable fins preferably are formed from a material having sufficient stiffness to avoid excessive bending during the power stroke. Typically, the fins may be formed from a polycarbonate resin, with the thickness selected to provide the desired degree of stiffness. The securing strap preferably is formed from woven polypropylene or Nylon for maximum flexibility and strength.

Strap ends may be secured together by any suitable adjustable fastening means. Conventional buckles may be used, with the type that includes a receiver and an insert that snaps into the receiver and is removed by transversely squeezing the insert being preferred. Also preferred is hook-and-loop material such as that available under the VELCRO® trademark.

The assembly may have any suitable length along a limb. Generally, those to be used on the arms will be shorter than those to be used on the legs. Of course, a shorter assembly could be used on either the arms or legs.

This movable fin swimming aid will greatly increase swimming efficiency and speed. This increase will especially benefit life guards at ocean beaches, large lake beaches or rivers. Long distance swimmers, Scuba divers, surfers, Navy Seals and others who need to swim distances as quickly as possible will also benefit as will those engaged in water aerobics.

BRIEF DESCRIPTION OF THE DRAWING

Details of the invention, and of preferred embodiments thereof, will be further understood upon reference to the drawing, wherein.

DETAILED DESCRIPTION OF PREFERRED EMBODIMENTS

Figure 1:
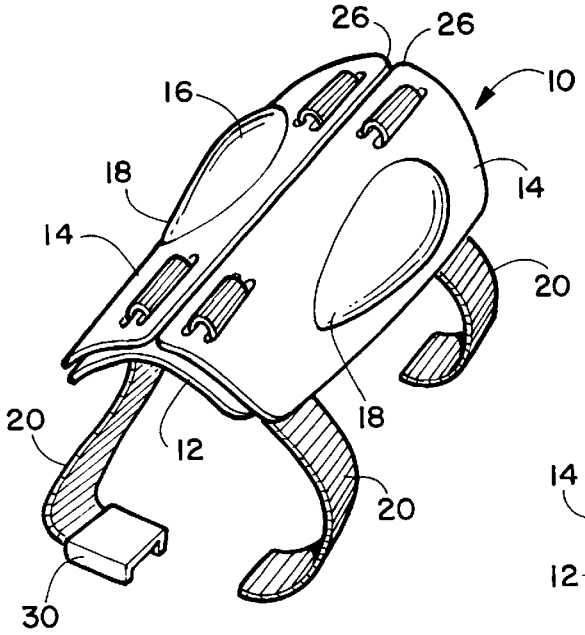
FIG. 1 is a perspective view of a first embodiment of the movable fin assembly of this invention.

Referring now to FIG. 1, there is seen a first embodiment of a movable fin assembly 10 that is particularly suitable for use on a swimmer's arms. Assembly 10 includes a support panel 12, two fins 14, and two straps 20.

As seen in FIGS. 1, 2, 4 and 5, support panel 12 is preferably elongated and sized to fit along the upper surface of the upper and/or lower arms of a swimmer. Support panel 12 may be formed from any suitable material. Panel 12 may be formed from a flexible plastic material and be shaped to fit an average sized arm with straps 20 bending the panel to conform to an individual arm. Alternately, support panels 12 may be made in a variety of sizes so that an individual could select panels that fit his or her arms. Or, support panels 12 could be made from a heat softenable material or a material such as fiber glass impregnated with a catalytically cured resin so that the panel could be shaped to precisely fit the swimmer's arm and cured thereon.

Each support panel 12 has two groups of two axial slots 24 equally spaced on opposite sides of centerline 22, with one group near each end of the panel for receiving straps 20, as detailed below.

Two generally elongated fins 14 are provided, each having a substantially straight first edge 26. Fins 14 may have any suitable shape. In this embodiment, straight edges 26 are spaced apart up to about 0.5 inch when the fins are secured to support plate 12.

Figure 5:
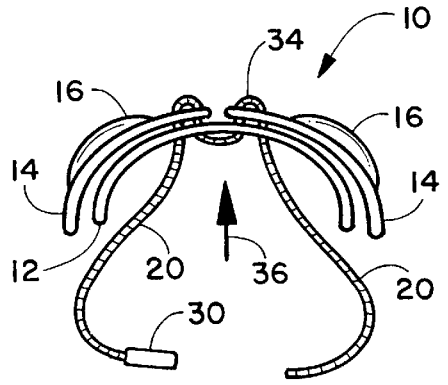
FIG. 5 is an end elevation view of the assembly of FIG. 1 during the recovery stroke.
Figure 3:
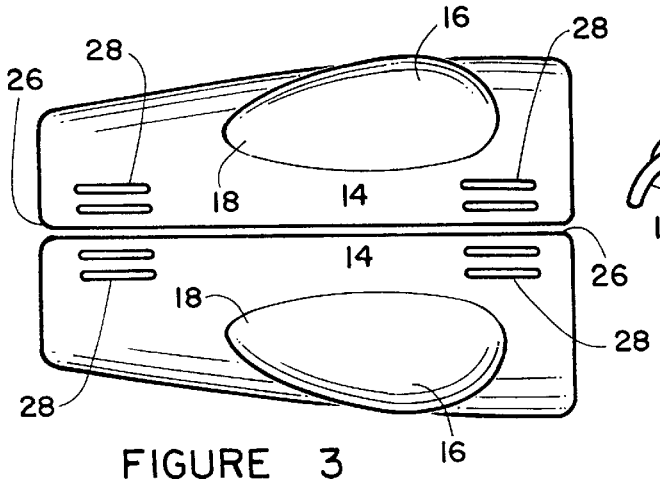
FIG. 3 is a plan view of the two movable fins.
Figure 4:
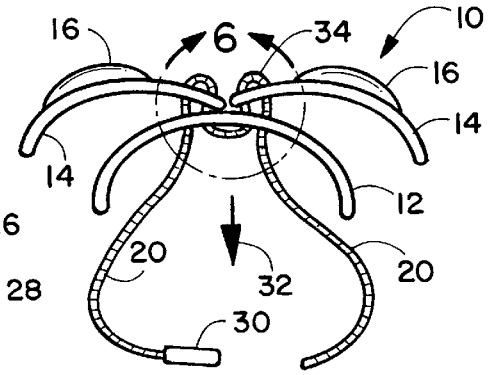
FIG. 4 is an end elevation view of the assembly of FIG. 1 during the power stroke.
Figure 2:
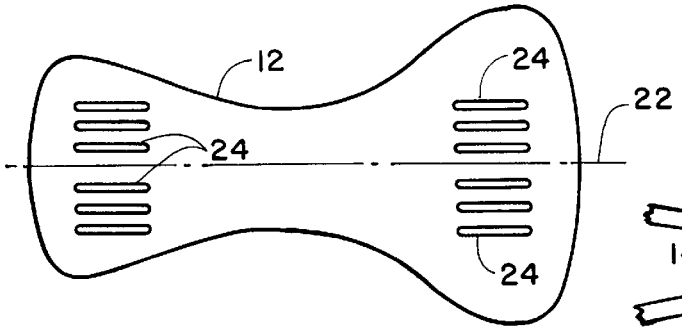
FIG. 2 is a plan view of the movable fin support panel.

As seen in FIGS. 4 and 5, a uniform axial curve over the majority of each fin 14 is often suitable. The fins may have a smooth overall curve or other configuration, as desired. For maximum efficiency and highest thrust during a swimmer's power stroke portion, an outward bulge 16 having a concave surface toward support panel 12 is preferably used to maximize efficiency. Where assembly 10 is used on an arm, generally a fairly uniform, somewhat elongated, approximately centrally located, bulge is preferred, with some tapering of one end 18 of bulge 16 as seen in FIGS. 1 and 2 is usually provides optimum efficiency.

Each fin has two axial slots 28 spaced adjacent to first edge 24. These slots 28 are located so that when fins 14 are placed over support panel 12 with fin edges 26 in, or nearly in, contact along panel centerline 22, fin slots 28 will align with panel slots 24. While slots 24 and 28 are preferably straight slots sized to accommodate the width of straps 20, if desired the slots could be curved or could be round to use a strap 20 having a round, rope-like central section and flat end sections to fit around the swimmer's limb.

Figure 6:
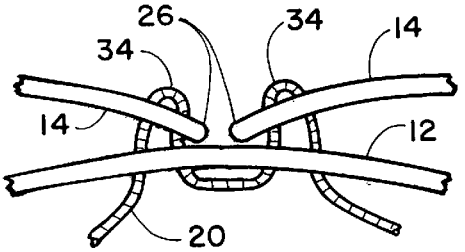
FIG. 6 is a detail view of the strap fastening area in FIG. 4.

Straps 20 are preferably threaded through slots 24 and 28 as shown in FIGS. 4–6 to flexibly hold the fins 14 against support panel 14 when the assembly is at rest as seen in FIG. 5. This unique strap 20 and slot arrangement provides a flexible means that serves the multiple functions of securing fins 14 to support plate 12, permitting pivoting of the fins about edge 26 and securing assembly 10 to a swimmer's limb.

A fastening means, here buckle 30, is used to secure assembly 10 to a swimmer's limb for use. Assembly 10 is positioned on the swimmer's limb at the position that will provide the maximum thrust when swimming. The fastening means may be a conventional tongue-and-hasp buckle, a buckle of the sort where a projection on one end of strap 20 is inserted in a socket on the other strap end and expands to releasably lock the strap ends together, hook-and-loop material of the sort available under the VELCRO® trademark and the like.

As seen in FIG. 4, when a swimmer makes a power stroke, with the limb moving in a direction intended to propel the swimmer forward, this movement (downwardly as indicated by arrow 32 in FIG. 4) will cause water flow to move fins 14 away from support panel 12, pivoting the fins into the extended position shown. This will result in a much greater thrust than would occur with the limb alone. The degree that fins 14 open will be in accordance with the tightness of straps 20 around the limb, which varies the forces on the strap loop 34 (as seen in FIG. 6) holding edges 26 against support panel 12. A user will adjust fastening means 20 to provide the degree of movement of fins in accordance with his or her arm movement forces and other preferences. Typically, a strong swimmer will tighten straps 20 more than would a less strong swimmer.

When the swimmer's limb ends the power stroke and direction is reversed in the recovery portion of the stroke, assembly 10 will be moving in the direction indicated by arrow 36 in FIG. 5. Water flowing past the limb will force fins 14 tightly against the support panel 12, desirably minimizing water resistance during recovery.

FIGS. 7–11 illustrate a second embodiment of the movable fin swimming aid of this invention. While the second embodiment could be used on upper and lower portions of arms or legs, if desired, this embodiment is optimized for use on legs.

Figure 7:
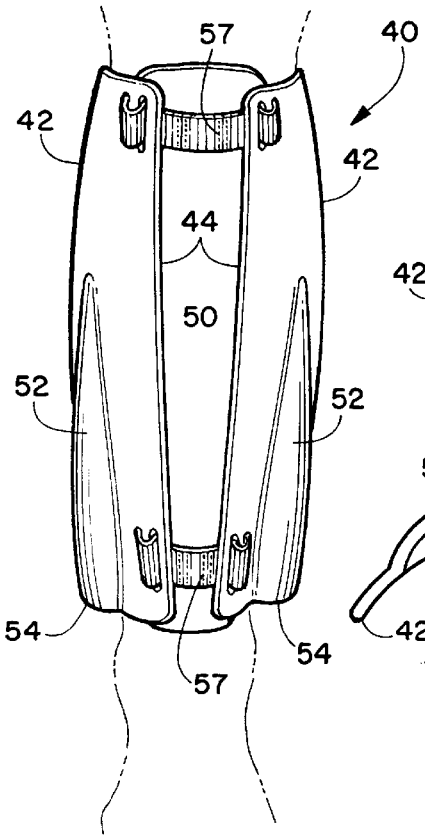
FIG. 7 is a perspective view of a second embodiment of the movable fin assembly of this invention.
Figure 10:
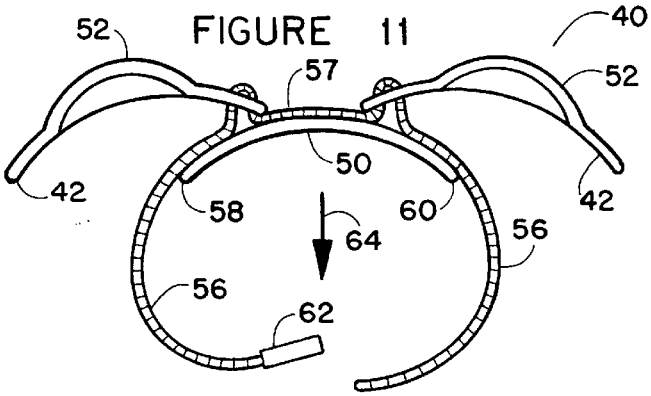
FIG. 10 is an end elevation view of the assembly of FIG. 7 during the power stroke.
Figure 9:
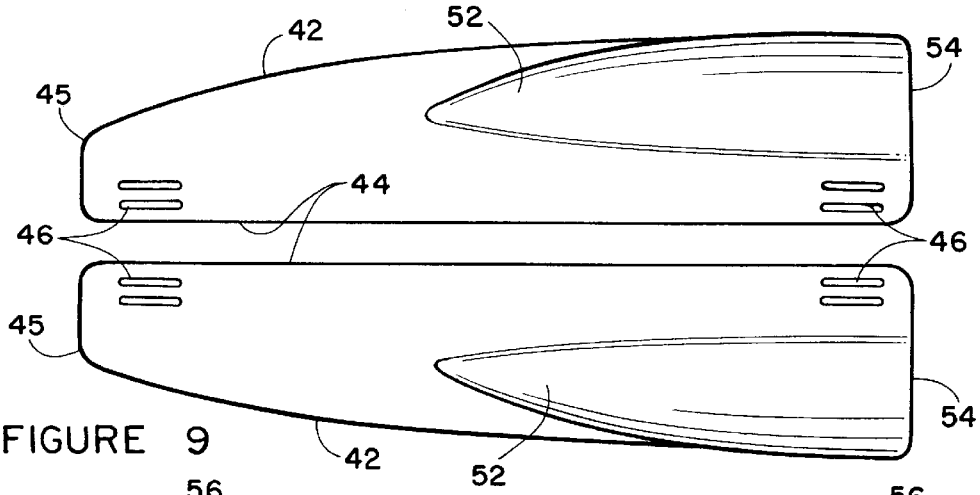
FIG. 9 is a plan view of the two movable fins in the second embodiment.

As seen in FIG. 7, assembly 40 is optimized for use on legs by being more elongated than assembly 10. Fins 42 as seen in FIGS. 7 and 10 are elongated and have an approximately straight inner edge 44 to optimize the pivoting fin movement. Pairs of slots 46 are provided adjacent to edge 44, near the ends of that edge. While fins 42 may have any suitable shape, including simply continuing the shape near end 45 over the entire fin length, for maximum efficiency and thrust, a tapered bulge 52, widest at end 54 near the center of the fin and extending toward end 45 is preferred. When used, the wide end 54 will extend toward the swimmer's feet or hands.

Figure 8:
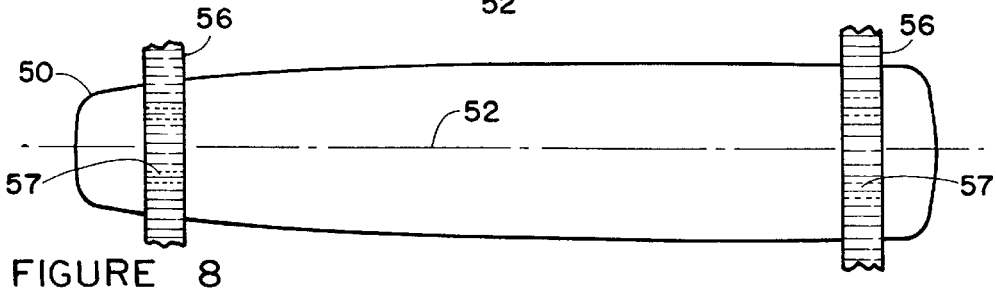
FIG. 8 is a plan view of the second embodiment movable fin support panel.

As seen in FIG. 8, the central portion 57 of strap 56 runs transversely along support 50 near centerline 52 and is secured to the support by sewing, staples or the like. Strap 56 is sewn to support panel 50 in the central area 57 that passes on the convex side of the support panel. Panel 50 may be formed from a material of any predetermined flexibility, from slightly flexible polyethylene or the like to a very flexible rubber.

Figure 11:
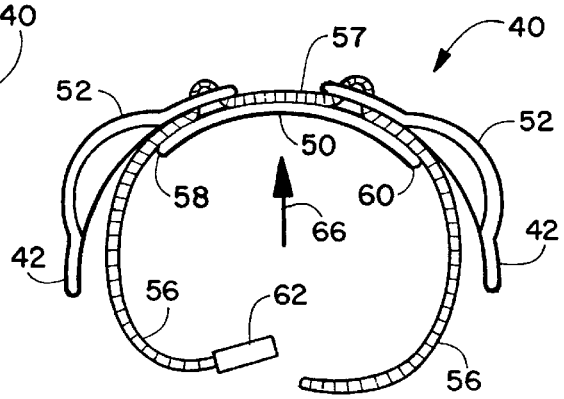
FIG. 11 is an end elevation view of the assembly of FIG. 7 during the recovery stroke.

As seen in FIGS. 10 and 11, in this embodiment, strap 56 is threaded around the exterior edge,58, through the outermost slot 46 then back through the innermost slot 46, similarly on the other side, then along the surface of edge 60 and back to buckle 62.

As discussed above with respect to the first embodiment, when the swimmers limb and assembly 40 moves in the power stroke indicated by arrow, water flow around the limb will force fins 42 to open to the position shown in FIG. 10, greatly increasing the thrust of the power portion of the stroke. During the recovery stroke portion, assembly 40 moves in the direction indicated by arrow 66, causing fins 42 to close closely around the swimmer's limb, reducing resistance to limb movement.

Figure 12:
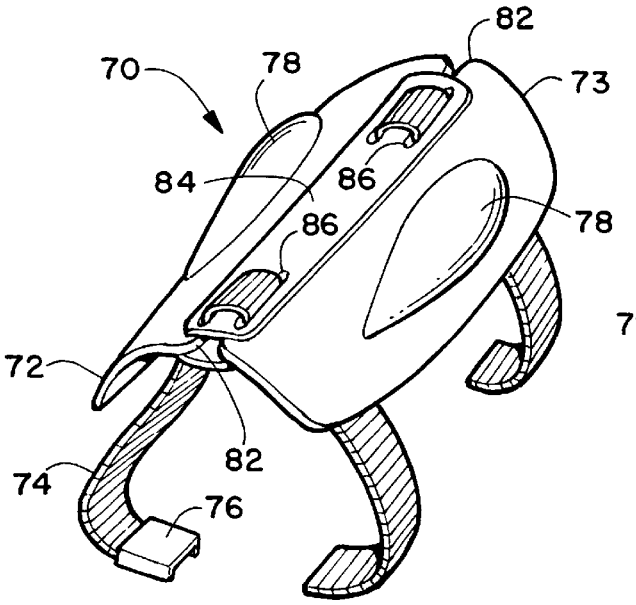
FIG. 12 is a perspective view of a third embodiment.

A perspective view of the third embodiment of assembly 70 of the swimming aid is shown in perspective view in FIG. 12. Here, the fins 72 and 73, straps 74 and buckles 76 are generally similar to the corresponding parts of the first two embodiments. Fins 72 and 73 preferably have bulges 78 to improve efficiency, although the bulges may be omitted, if desired. As with the embodiment of FIG. 1, the adjacent edges 82 of fins 72 and 73 are approximately straight and are closely spaced, preferably up to about 0.5 inch.

Figure 14:
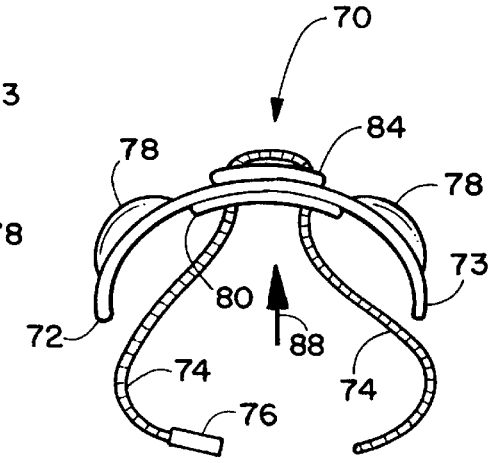
FIG. 14 is a front elevation view of the third embodiment during the recovery stroke.
Figure 13:
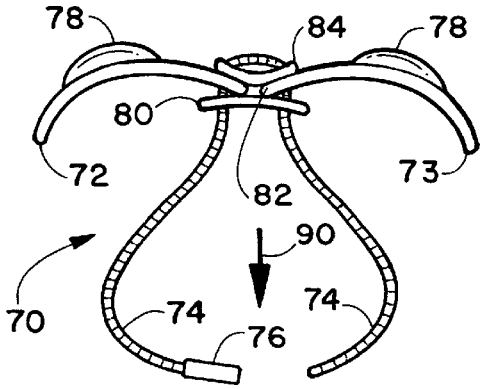
FIG. 13 is a front elevation view of the third embodiment during the power stroke.
Figure 15:
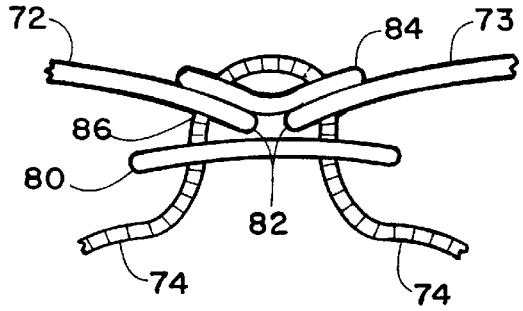
FIG. 15 is a detail view of the fin hinge arrangement.

The hinge arrangement, as seen in FIGS. 13–15 of assembly 70 is quite different. Support panel 80 is formed from a flexible material, such as rubber of the sort used in automobile tires. A top member 84 of similar flexible material abuts the upper surfaces of fins 70 along the straight fin edge. Strap 74 passes through a slot in support panel 80, then through an aligned similar slot in fin 72 and slot 86 (as seen in FIG. 12) in top member 84, and finally down though similar aligned slots in top member 48, fin 73 and support panel 80. These slots are configured and located similarly to corresponding slots in the first and second embodiments.

As seen in FIGS. 13–15, when strap 74 is tightened around a swimmer's limb, top member 84 will bias fins 72 and 73 toward the position seen in FIG. 14, during a swimming recovery portion of a stroke, when the limb (not shown) is moving in the direction represented by arrow 88 to reduce resistance to the limb and assembly 70 moving through the water. When a power stroke is begun, the limb is moving in a direction represented by arrow 90. Water flow along the limb will then bias fins 72 and 73 toward to position shown in FIG. 13. The extent of fin movement will be limited by the pressure of top member 84 against the upper surfaces of fins 72 and 73 and the resistance of top member to bending. Also, the tightness of strap 74 will influence the moment of fins 72 and 73. By selecting the physical characteristics of top member 84, fins 72 and 73 will move to approximately the position shown in FIG. 13 with an average swimmer. Fine tuning can be accomplished by adjusting the tightness of strap 74. Of course, top members having different flexure characteristics can be selected by swimmers of different stroke power to optimize system efficiency.

Other applications, variations and ramifications of this invention will occur to those skilled in the art upon reading this disclosure. Those are intended to be included within the scope of this invention, as defined in the appended claims.

I claim:

1. A swimming aid with movable fins, which comprises:

two elongated fins, each having one approximately straight first edge and a substantially uniform axial curve over the majority of each fin;

each of said fins has an approximately central bulge formed in said substantially uniform axial curve, said central bulge having a concave surface towards said support panel;

an elongated support panel configured to fit against a person's limb;

said support panel having a longitudinal centerline;

flexible means for holding said fins in contact with said support panel with said first edges aligned with said centerline while permitting rotation of said fins toward and away from said support panel; and said flexible means further including means for securing said support panel against a person's limb.

2. The swimming aid with movable fins according to claim 1 wherein said fin first edges are spaced less than about 0.5 inch apart.

3. The swimming aid with movable fins according to claim 1 wherein said fin first edges are spaced from about 3 to about 6 inches apart.

4. The swimming aid with movable fins according to claim 1 wherein each of said fins has said bulge extending from one longitudinal edge to approximately a central fin area with said concave surface towards said support panel.

5. The swimming aid with movable fins according to claim 1 wherein said two elongated fins are approximately mirror images of each other.

6. The swimming aid with movable fins according to claim 1 wherein said flexible means comprises two spaced pairs of spaced fin slots adjacent to said straight first edge, corresponding slots in said support panel to align with said spaced fin slots and a strap extending through said slots to flexibly hold said fins against said support panel, said strap having fastening means for fastening ends of said strap around a swimmer's limb.

7. The swimming aid with movable fins according to claim 1 wherein said flexible means comprises two spaced pairs of spaced fin slots adjacent to said straight first edge, corresponding slots in said support panel to align with the said fin slots nearest said straight first edge and two straps, each said strap threaded through a fin slot furthest from said straight first edge from the side of a first fin in contact with said support panel, back through the fin slot neatest said straight first edge and said corresponding support panel slot, through the opposite support panel slot, through the slot nearest the straight first edge in the second fin and back through the slot in the second fin furthest from said straight first edge, said strap having fastening means for fastening ends of said strap around a swimmer's limb.

8. A swimming aid with movable fins, which comprises:

two elongated fins, each having one approximately straight first edge;

said two elongated fins being approximately mirror images of each other;

each fin having forward and aft pairs of adjacent openings, spaced along said first edge;

an elongated support panel configured to fit against a person's limb;

said support panel having a longitudinal centerline;

forward and aft openings spaced along adjacent to said longitudinal centerline;

at least some of said forward and aft fin openings and support panel openings substantially aligning when said fins are placed against said support panel with said fin first edges substantially aligned with said support panel longitudinal centerline;

straps extending through said forward and aft aligned openings to hold said fin first edges adjacent to said support panel while permitting rotation of said fins away from said support panel around said first edges.

9. The swimming aid with movable fins according to claim 8 wherein said fin first edges are spaced less than about 0.5 inch apart.

10. The swimming aid with movable fins according to claim 8 wherein said fin first edges are spaced from about 3 to about 6 inches apart.

11. The swimming aid with movable fins according to claim 8 wherein each of said fins has an approximately central bulge having a concave surface towards said support panel.

12. The swimming aid with movable fins according to claim 8 wherein each of said fins has a bulge extending from one longitudinal edge to approximately a central fin area with a concave surface towards said support panel.

13. The swimming aid with movable fins according to claim 1 wherein said flexible means comprises two spaced pairs of spaced fin slots adjacent to said straight first edge, corresponding slots in said support panel to align with said spaced fin slots and a strap extending through said slots to flexibly hold said fins against said support panel, said strap having fastening means for fastening ends of said strap around a swimmer's limb.

14. The swimming aid with movable fins according to claim 1 wherein said flexible means comprises two spaced pairs of spaced fin slots adjacent to said straight first edge, corresponding slots in said support panel to align with the said fin slots nearest said straight first edge and two straps, each said strap threaded through a fin slot furthest from said straight first edge from the side of a first fin in contact with said support panel, back through the fin slot neatest said straight first edge and said corresponding support panel slot, through the opposite support panel slot, through the slot nearest the straight first edge in the second fin and back through the slot in the second fin furthest from said straight first edge, said strap having fastening means for fastening ends of said strap around a swimmer's limb.

15. A swimming aid with movable fins, which comprises:

an elongated support panel formed from a flexible material and configured to fit against a person's limb;

said support panel having a longitudinal centerline;

two elongated fins, each having one approximately straight first edge positioned over said support panel with said straight edges aligned approximately parallel with said longitudinal centerline;

an elongated flexible member positioned over said fin along said straight edges;

slots located in said flexible member and said two elongated fins, and said elongated support panel;

strap means passing through said slots in said flexible member and said two elongated fins and said elongated support panel to bias said fins toward a position adjacent to said support panel while allowing said fins to pivot about said straight edges when said bias is overcome;

said strap further having end portions configured to fit around a swimmer's limb; and means for fastening said strap around a swimmer's limb.

16. The swimming aid according to claim 15, wherein said support panel and flexible member are formed from rubber having predetermined flexibility.

17. The swimming aid with movable fins according to claim 15 wherein said fin first edges are spaced less than about 0.5 inch apart.

18. The swimming aid with movable fins according to claim 15 wherein each of said fins has an approximately central bulge having a concave surface towards said support panel.

19. The swimming aid with movable fins according to claim 15 wherein said two elongated fins are approximately mirror images of each other.

* * * * *